US008191863B2

(12) United States Patent
Roberts

(10) Patent No.: US 8,191,863 B2
(45) Date of Patent: Jun. 5, 2012

(54) STAPLE REMOVER

(76) Inventor: John D. Roberts, Austin, TX (US)

( * ) Notice: Subject to any disclaimer, the term of this patent is extended or adjusted under 35 U.S.C. 154(b) by 248 days.

(21) Appl. No.: 12/656,806

(22) Filed: Feb. 17, 2010

(65) Prior Publication Data

US 2010/0207080 A1 Aug. 19, 2010

Related U.S. Application Data

(60) Provisional application No. 61/202,296, filed on Feb. 17, 2009.

(51) Int. Cl.
*B25C 11/00* (2006.01)

(52) U.S. Cl. ..... 254/28; 254/21

(58) Field of Classification Search ..... 254/28, 254/21, 22

See application file for complete search history.

(56) References Cited

U.S. PATENT DOCUMENTS

| | | | | |
|---|---|---|---|---|
| 1,225,723 | A * | 5/1917 | Singer | 29/248 |
| 2,675,989 | A * | 4/1954 | Vogel | 254/28 |
| 3,447,172 | A | 6/1969 | Clark | |
| 6,772,996 | B1 * | 8/2004 | Carlson et al. | 254/28 |
| 6,854,714 | B1 * | 2/2005 | Wood | 254/28 |
| 2010/0207080 | A1 * | 8/2010 | Roberts | 254/28 |

* cited by examiner

*Primary Examiner* — Lee D Wilson
(74) *Attorney, Agent, or Firm* — Richard C. Litman

(57) ABSTRACT

The staple remover is a device that effectively removes staples, especially staples that have already been partially removed. The device includes top and bottom jaws that are pivotally connected in pliers-like fashion. A conventional spring biases the jaws apart. Each jaw is provided with a toothed or serrated-like inner surface. The outer surface of each jaw is padded to enhance ergonomic dexterity and comfort. An elongate prong extends from the front surface of the bottom jaw.

12 Claims, 6 Drawing Sheets

STAPLE REMOVER

CROSS-REFERENCE TO RELATED APPLICATION

This application claims the benefit of U.S. Provisional Patent Application Ser. No. 61/202,296, filed Feb. 17, 2009.

BACKGROUND OF THE INVENTION

1. Field of the Invention

The present invention generally relates to hand tools, and more specifically, to a staple remover.

2. Description of the Related Art

One of the more annoying tasks of office work is that of separating attached paper sheets, especially if the sheets are attached by means of the ubiquitous wire staple. Normally, a conventional, jaw-type or pen-type staple puller is employed to remove the wire staples from the sheets. More often than desired, the conventional staple remover only partially removes the wire staple. Efforts, sometimes heroic, must then be made to grasp the staple with one's fingers and completely remove the staple from the paper sheets. A device that could safely and easily remove these partially removed staples would certainly be a welcome addition to the art. Thus, a staple remover solving the aforementioned problems is desired.

SUMMARY OF THE INVENTION

The staple remover effectively functions to remove staples, especially staples that have been partially removed. The device comprises first and second jaws that are pivotally connected in pliers-like fashion. A flexible hinge structure biases the jaws apart. Each jaw is provided with a toothed or serrated inner surface. The outer surface of each jaw is padded to enhance ergonomic dexterity and comfort. A magnetized, elongate prong (whose function is explained below) extends from the front end of one of the two jaws.

Accordingly, the invention presents a device for effectively removing staples, which is efficient and durable. The device incorporates features to enhance comfort and effectiveness. The invention provides for improved elements thereof in an arrangement for the purposes described that are inexpensive, dependable and fully effective in accomplishing its intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
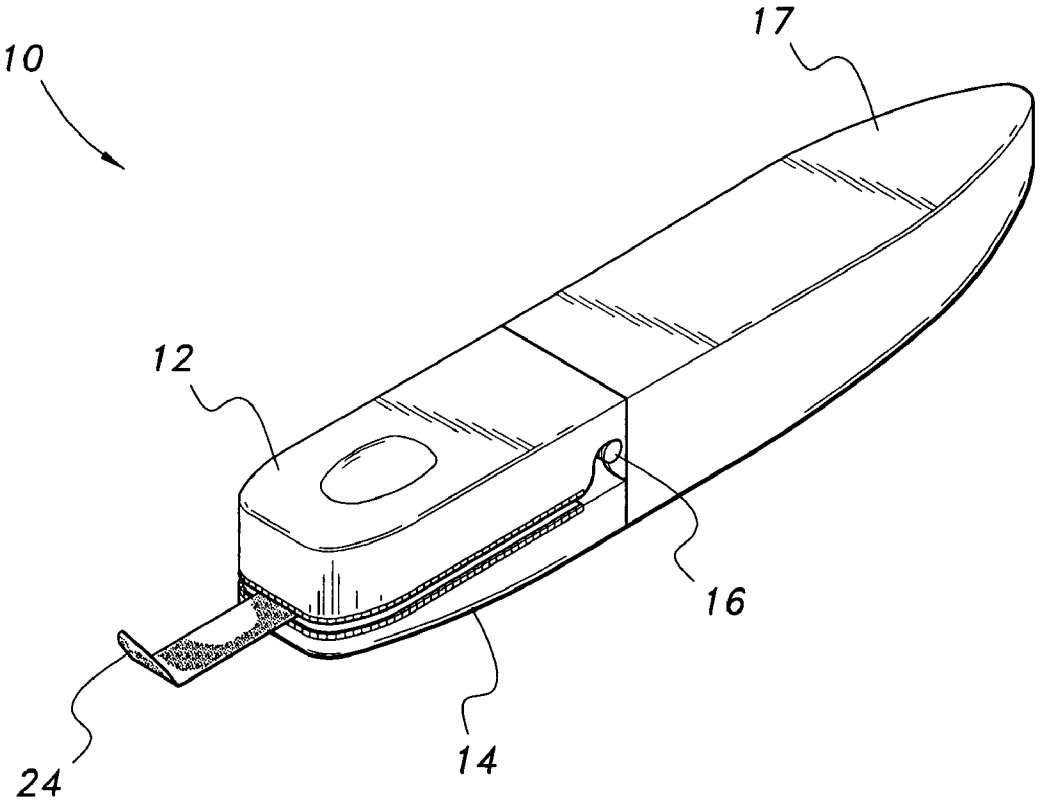
FIG. 1 is a perspective view of a staple remover according to the present invention.
Figure 2:
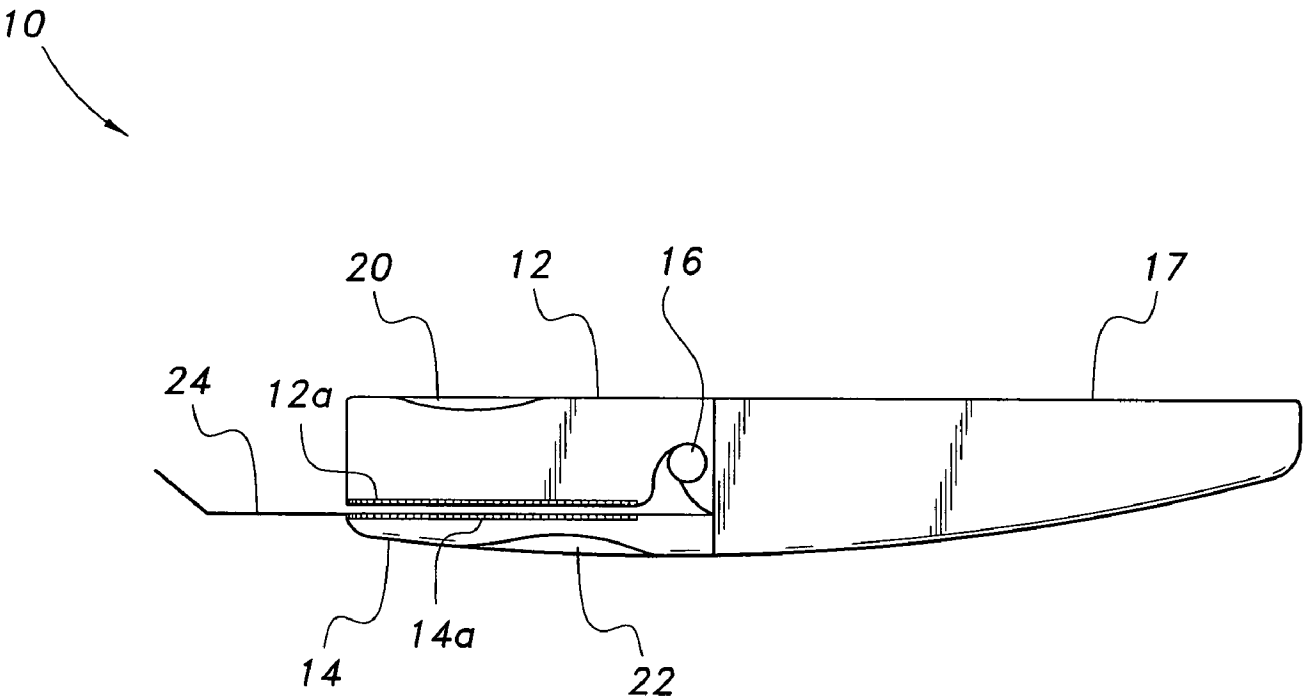
FIG. 2 is a side view of a staple remover according to the present invention.
Figure 5:
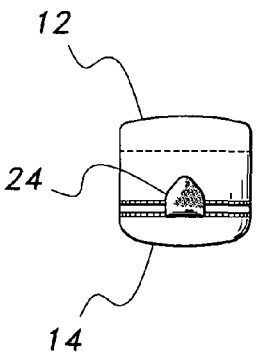
FIG. 5 is a front view of a staple remover according to the present invention.
Figure 4:
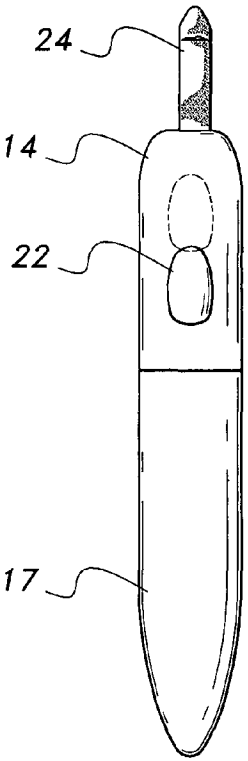
FIG. 4 is a bottom view of a staple remover according to the present invention.
Figure 3:
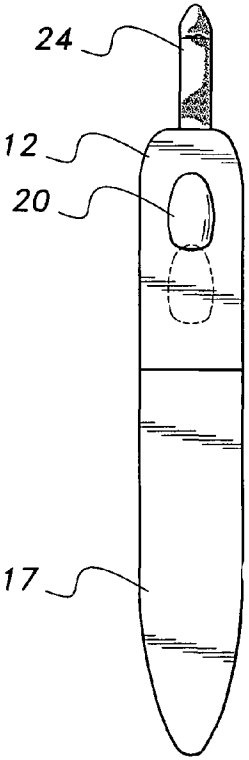
FIG. 3 is a top view of a staple remover according to the present invention.

Referring to FIGS. 1-5, the staple-remover 10 comprises respective first and second jaws 12 and 14 pivotally hinged together at their respective distal ends in a pliers-like arrangement. A resilient, flexible structure 16 defines the hinge. The resilient, flexible hinge 16 can take the form of a coiled spring or any plastic or synthetic material that is sufficiently flexible to bias the jaws apart and permit opening and closing thereof without fatiguing or cracking. A short handle portion 17 extends rearward from the hinge 16. The inner surfaces of each respective jaw 12, 14 are provided with teeth or serrations 12*a*, 14*a* for gripping the staples during the removal process. Respective padded indentations 20, 22 are disposed on the outer surface of each jaw 12, 14 to enhance comfort and provide ergonomic facility for the user. A magnetized, elongate prong 24 extends from the front end of jaw 14. Prong 24 is employed to slip under and lift a staple. The staple will be magnetically attracted to the prong to enhance removal.

Figure 6:
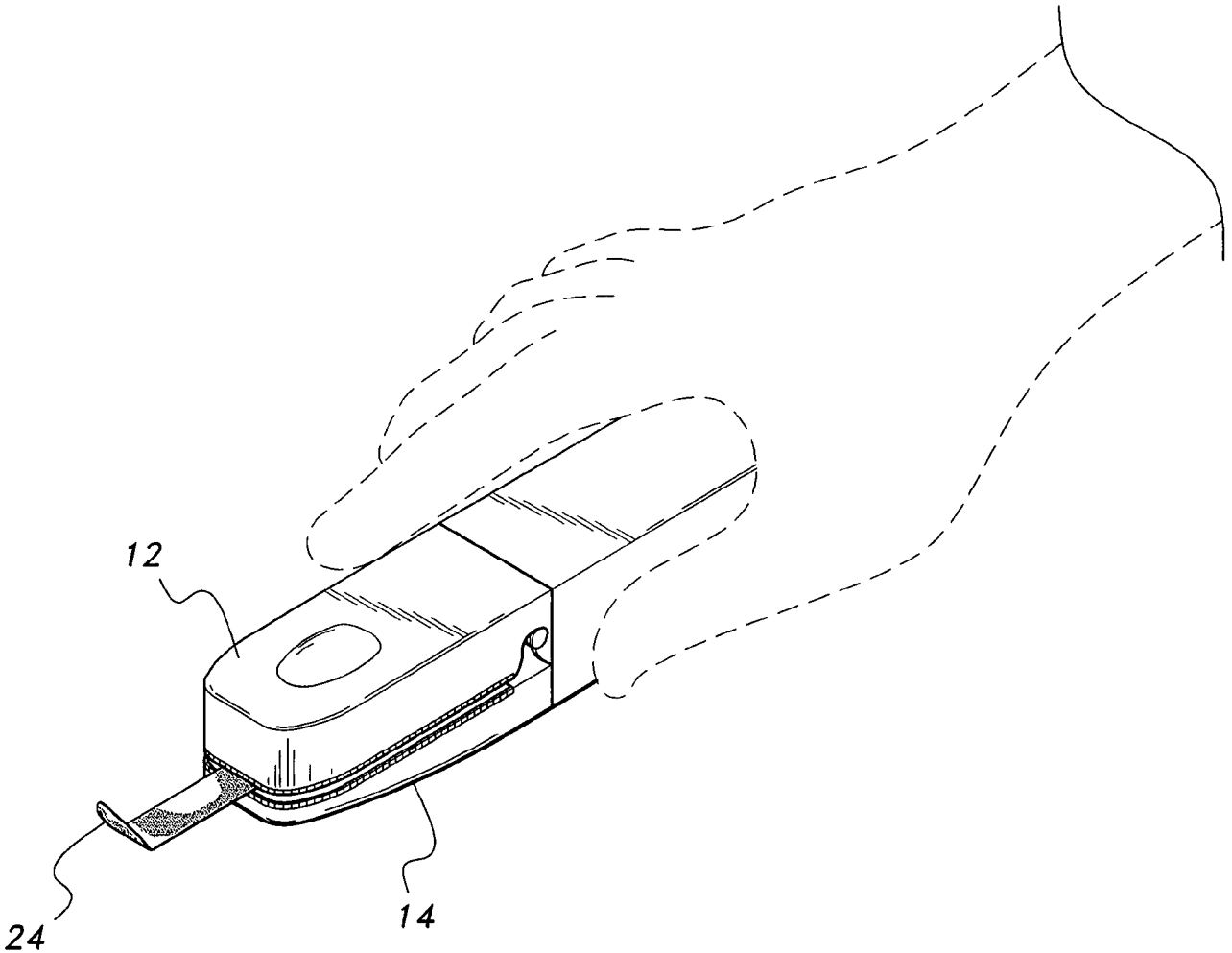
FIG. 6 is a perspective view of a staple remover according to the present invention, shown in use.
Figure 7A:
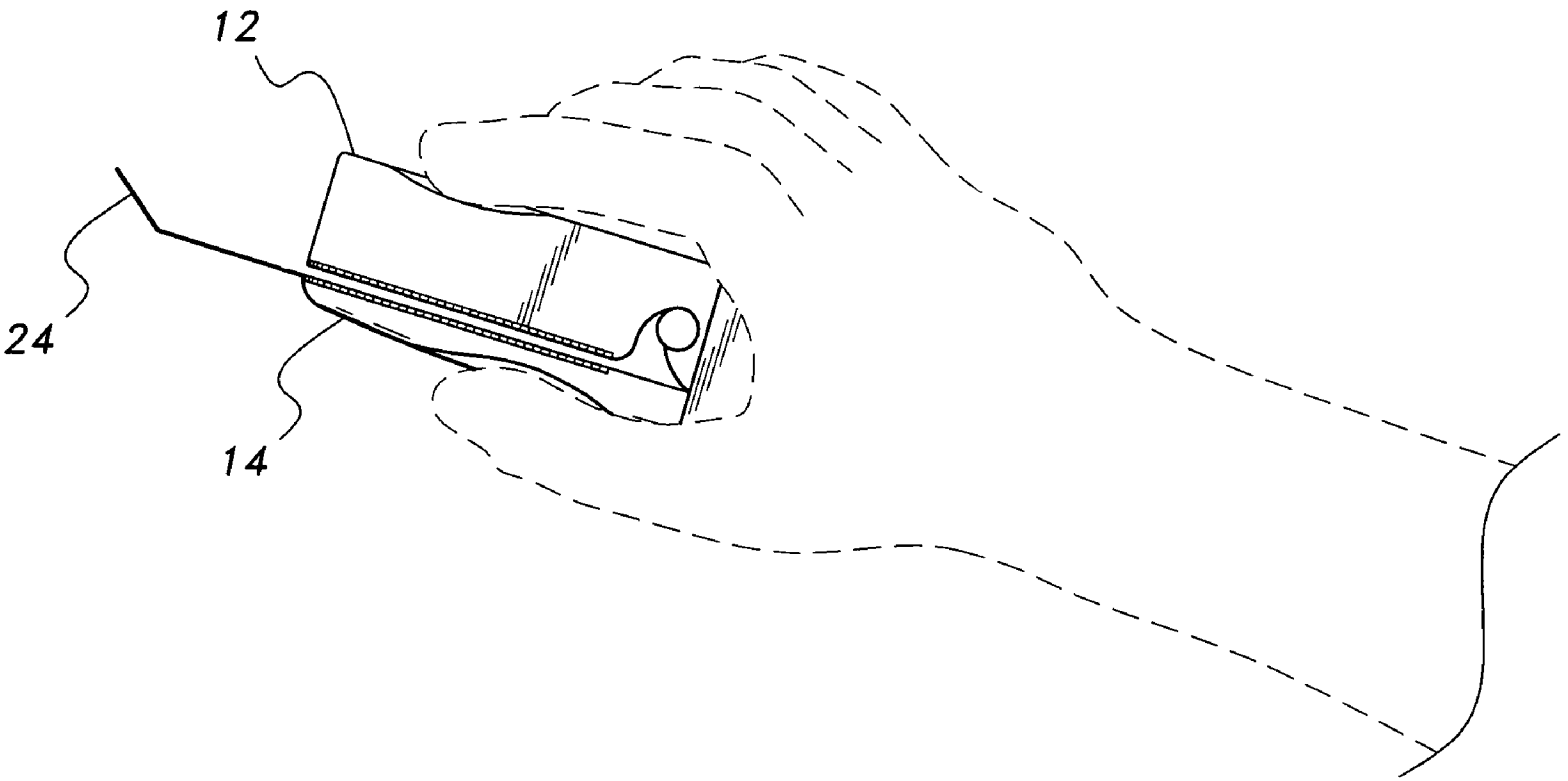
FIG. 7A is a perspective view of a staple remover according to the present invention, shown in use in a first rotated position.
Figure 7B:
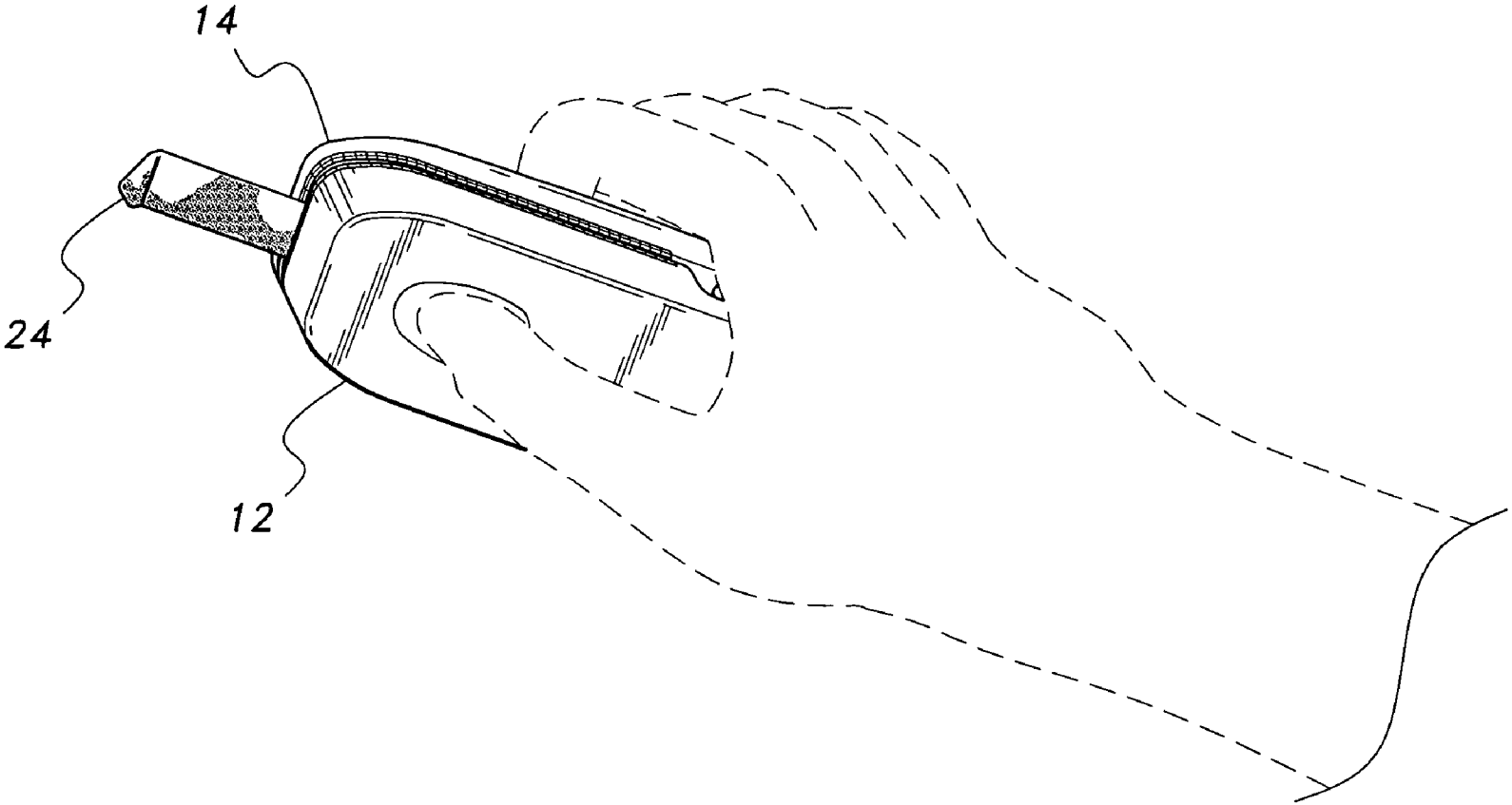
FIG. 7B is a perspective view of a staple remover according to the present invention, shown in use in a second rotated position.

In use, the user holds the device as in FIG. 6, inserts the prong 24 underneath an embedded staple (not shown), and then pushes forward to remove the staple. If, after pushing forward, the staple is not completely removed by the joint actions of the prong 24 and the curved undersurface of the jaw 14 (the curved undersurface causes the staple remover 10, when pushed forward, to lift the embedded staple), then the user rotates the staple remover 10 forty-five degrees to the right and places the index finger on the padded surface of the upper jaw 12 and the thumb on the padded surface of the lower jaw 14 (as shown in FIG. 7A), or, rotates the staple remover 10 forty-five degrees to the left and places the index finger on the padded surface of the lower jaw 14 and the thumb on the padded surface of the upper jaw 12 (as shown in FIG. 7B), whichever is most comfortable. Then, with the staple remover 10 so rotated, the user grasps the partially removed staple by means of the toothed inner surfaces of the upper and lower jaws 12, 14 and pulls the device to remove the staple entirely.

It is to be understood that the present invention is not limited to the embodiment described above, but encompasses any and all embodiments within the scope of the following claims.

I claim:

1. A staple remover for removing wire staples, comprising:

a first jaw member having a front end, a rear end, an inner surface and an outer surface, the outer surface having a first indentation therein;

a second jaw member having a front end, a rear end, an inner surface and an outer surface, the outer surface having a second indentation therein;

a hinge member connecting the rear end of the first jaw member to the rear end of the second jaw member;

a first plurality of gripping devices disposed on the inner surface of the first jaw member;

a second plurality of gripping devices disposed on the inner surface of the second jaw member; and an elongate prong member attached to the front end of said second law member, the prong member extending forwardly therefrom.

2. The staple remover according to claim 1, wherein said first indentation and said second indentation are padded.

3. The staple remover according to claim 1, further including a handle member attached to the rear end of said first jaw member and the rear end of said second jaw member, the handle member extending rearwardly therefrom.

4. The staple remover according to claim 1, wherein said first plurality of gripping devices and said second plurality of gripping devices are serrations.

5. The staple remover according to claim 1, further including an elongate, magnetized prong member attached to the front end of said second jaw member, the prong member extending forwardly therefrom.

6. A staple remover for removing wire staples, comprising:

a first jaw member having a front end, a rear end, an inner surface and an outer surface, the outer surface having a first padded indentation therein;

a second jaw member having a front end, a rear end, an inner surface and an outer surface, the outer surface having a second padded indentation therein;

a flexible hinge member connecting the rear end of the first jaw member to the rear end of the second jaw member, the flexible hinge member biasing the first jaw member from the second jaw member;

a first plurality of gripping devices disposed on the inner surface of the first member;

a second plurality of gripping devices disposed on the inner surface of the second jaw member; and an elongate prong member attached to the front end of said second jaw member, the prong member extending forwardly therefrom.

7. The staple remover according to claim 6, further including a handle member attached to the rear end of said first jaw member and the rear end of said second jaw member, the handle member extending rearwardly therefrom.

8. The staple remover according to claim 6, wherein said first plurality of gripping devices and said second plurality of gripping devices are serrations.

9. The staple remover according to claim 6, further including an elongate, magnetized prong member attached to the front end of said second jaw member, the prong member extending forwardly therefrom.

10. A staple remover for removing wire staples, comprising:

a first jaw member having a front end, a rear end, an inner surface and an outer surface, the outer surface having a first padded indentation therein;

a second jaw member having a front end, a rear end, an inner surface and an outer surface, the outer surface having a second padded indentation therein;

a flexible hinge member connecting the rear end of the first jaw member to the rear end of the second jaw member, the flexible hinge member biasing the first jaw member from the second jaw member;

a first plurality of serrations disposed on the inner surface of the first jaw member;

a second plurality of serrations disposed on the inner surface of the second jaw member; and an elongate prong member attached to the front end of the second jaw member, the prong member extending forwardly therefrom.

11. The staple remover according to claim 10, wherein said elongate prong member is magnetized.

12. The staple remover according to claim 11, further including a handle member attached to the rear end of said first jaw member and the rear end of said second jaw member, the handle member extending rearwardly therefrom.

* * * * *